United States Patent [19]

Molloy

[11] Patent Number: 4,478,414

[45] Date of Patent: Oct. 23, 1984

[54] ELASTIC ANKLE AND KNEE EXERCISER

[76] Inventor: Lawrence Molloy, 84-49 265th St., Floral Park, N.Y. 11001

[21] Appl. No.: 470,058

[22] Filed: Feb. 28, 1983

[51] Int. Cl.[3] ..... A63B 21/00

[52] U.S. Cl. ..... 272/134; 272/136; 272/142

[58] Field of Search ..... 272/142, 134, 136, DIG. 4, 272/143, 900, 139; 24/59, 115 R, 136 R

[56] References Cited

U.S. PATENT DOCUMENTS

| | | | |
|---|---|---|---|
| 821,783 | 5/1906 | Clease | 272/137 |
| 2,467,943 | 4/1949 | Mikell | 272/142 X |
| 2,498,006 | 2/1950 | Ridill | 272/142 X |
| 4,325,548 | 4/1982 | Piccini | 272/142 X |

FOREIGN PATENT DOCUMENTS

| | | | |
|---|---|---|---|
| 458831 | 8/1913 | France | 272/142 |
| 434067 | 8/1935 | United Kingdom | 272/142 |

*Primary Examiner*—Richard J. Apley
*Assistant Examiner*—William R. Browne
*Attorney, Agent, or Firm*—Michael I. Kroll

[57] ABSTRACT

An exercising device is provided to exercise the knee and ankle by providing straps attached to elastic members wherein the operator's foot is firmly grasped and the entire apparatus is held in place by the user attaching it to the back of a chair with the user sitting in said chair and moving his ankle and knee against the tension created by the invention on said knee and ankle. A strap forming a noose is attached to the ends of the elastic members. A force on the noose by a user's limb causes the noose to tightly engage the limb of a user.

1 Claim, 9 Drawing Figures

ELASTIC ANKLE AND KNEE EXERCISER

BACKGROUND OF THE INVENTION

1. Field of the Invention

The instant invention relates generally to an exercising device and specifically said device relates to a device that is used to exercise an individuals ankles and knees.

2. Description of the Prior Art

There are an ever increasing number of devices to aid an individual who desires to strengthen a particular part of his body, but an area that has been neglected is the front and sides of the ankle and knee.

Accordingly it is an object of the instant invention to provide a low cost device that may be used with a conventional chair, said device easily used so that one can exercise their ankles and knees in order to strengthen the muscles and tendons of said ankles and knees.

It is most important that the neglected muscles of the front (anterior) and the sides (medial and lateral) of the leg be exercised in order to balance the stronger muscles of the back (posterior) of the leg.

Physicians universally agree that the strengthening of muscles and tendons in the area surrounding the joints aids substantially in the prevention and rehabilitation of various types of joint injuries.

Accordingly it is an object of the instant invention to provide an exercise device that will improve the integrity of the ankle and knee joints.

It is an additional object of the instant invention to provide a low cost, easy to use device for athletes who desire to strengthen the muscles and tendons in the aforementioned areas.

SUMMARY OF THE INVENTION

The instant invention offers a substantial improvement over the prior art as more fully described hereinafter.

A strap device is provided having a loop wherein either the left or right foot of an individual is inserted, said loop having two ends that have attached to each of said ends a strap, said straps each attached to an elastic cord with a second chair strap attached to the ends of said elastic cords. The chair strap is wrapped around a chair so that when the individual sits in said chair the device can be adjusted so that the device is snugged up.

By snugging up on the device the operator will have to exert a force on said device in order to move his foot, knee or ankle and said exertion will result in the operator exercising a particular muscle or tendon.

DESCRIPTION OF THE PREFERRED EMBODIMENTS

Figure 1:
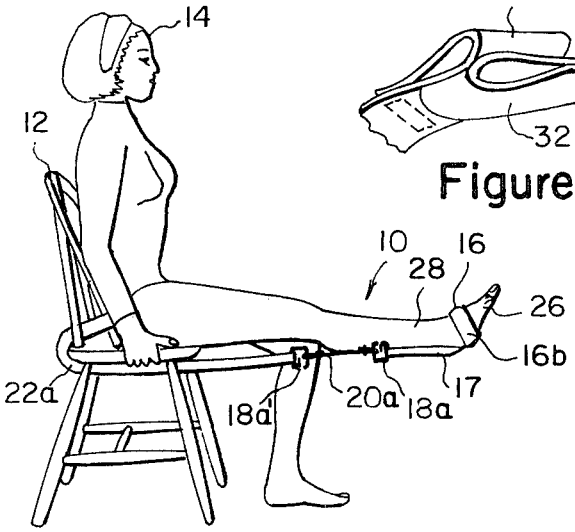
FIG. 1 of the drawing shows the instant invention in operation wherein an individual is exercising their right leg.
Figure 3:
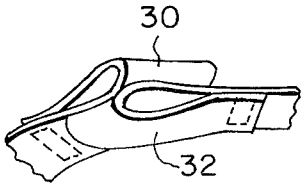
FIG. 3 of the drawing is a partial perspective view of the invention.
Figure 2:
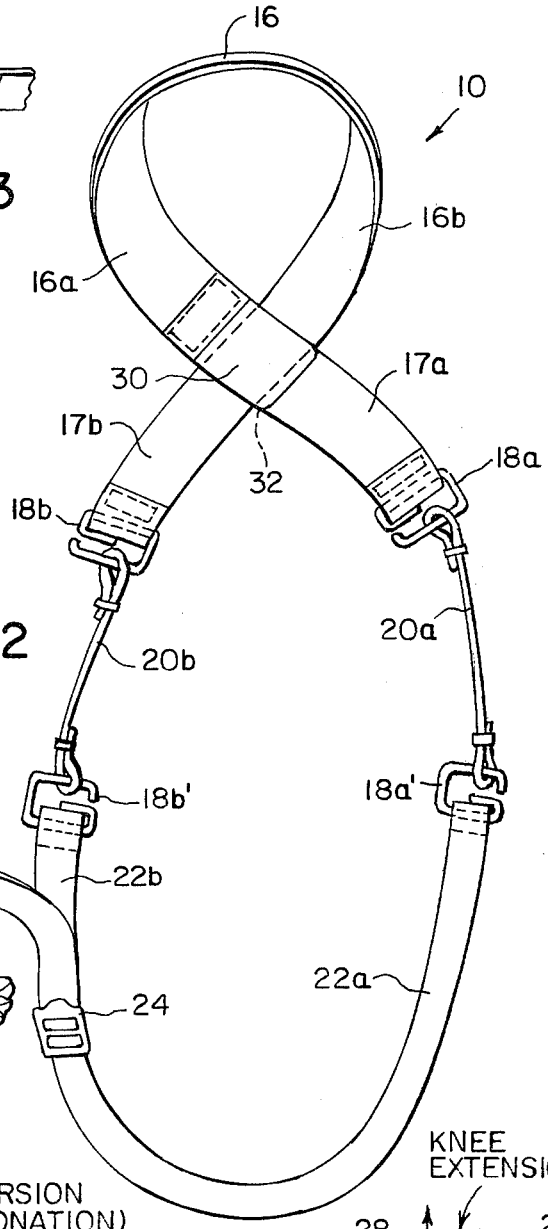
FIG. 2 of the drawing is a perspective view of the invention.

Turning now descriptively to the drawing in which similar elements throughout the several views have similar numbers, FIG. 1 of the drawing shows the invention in use while FIG. 2 of the drawing is a perspective view of the invention.

FIG. 2 of the drawing shows two straps 16*a* and 16*b* each having an end with loops 32 and 30 sewn into said ends with said loops themselves sewn together at ninety degrees to one another with the loops remaining open so that the other ends of straps 16*a* and 16*b* may be inserted through the other loop to form noose 16 so that when the user's foot is inserted into noose 16, the force exerted on 17*a* and 17*b* will reduce said noose 16 so that the foot is held firmly in place in said noose.

Straps 17*a* and 18*a* are connected to elastic members 20*a* and 20*b* respectively which are then joined together with chair strap at 22*a* and 22*b* respectively with buckle 24 being ajustable in order that the invention be universal in size.

In operation the assembly is positioned as in FIG. 1 with the operator 14 positioned as shown in chair 12. The chair strap 22*a* and 22*b* is placed over the back of said chair 12 and underneath the seat of chair 12, and inside of the legs. Noose 16 is then inserted over the toes of operator 14 so that the two straps 16*a* and 16*b* are located on the sides of foot 26 and the heel of the user rests on the two sewn loops 30 and 32. Buckle 24 on chair strap 22*a* and 22*b* is adjusted so that all slack is removed when leg 28 is perpendicular to the floor.

KNEE MOVEMENTS

Figure 6A:
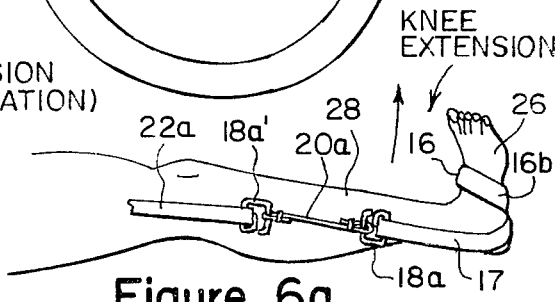
FIG. 6*a* of the drawing is a perspective view of the invention wherein the user's knee is in extension.
Figure 6B:
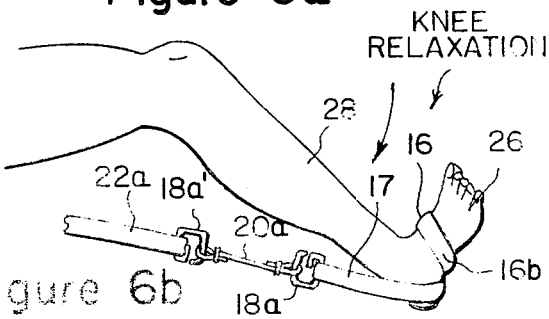
FIG. 6*b* of the drawing is a perspective view of the invention wherein the user's knee is in relaxation.

With the foot held still the knee is straightened against the tension of elastic member 20*a* and held for three seconds and slowly relaxed so that leg 28 returns to a position that is perpendicular with the floor, said cycle being repeated ten to fifteen times as shown in FIGS. 6*a* and 6*b*.

ANKLE MOVEMENTS

Figure 4A:
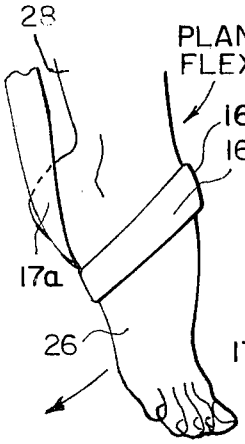
FIG. 4*a* of the drawing is a perspective view of the invention wherein the user's foot is in plantar flexion.
Figure 4B:
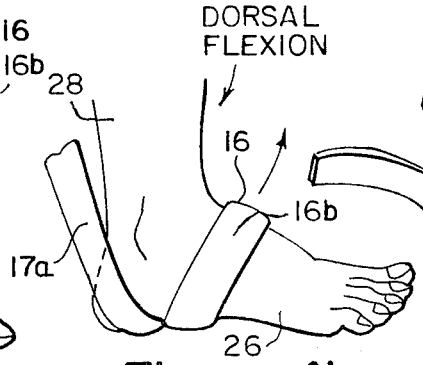
FIG. 4*b* of the drawing is a perspective view of the invention wherein the user's foot is in dorsal flexion.
Figure 5A:
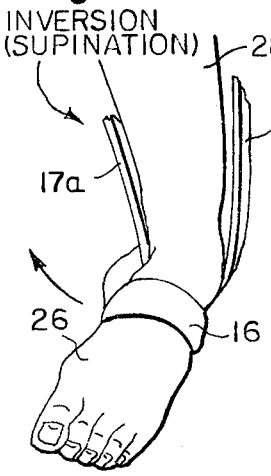
FIG. 5*a* of the drawing is a perspective view of the invention wherein the user's foot is in inversion.
Figure 5B:
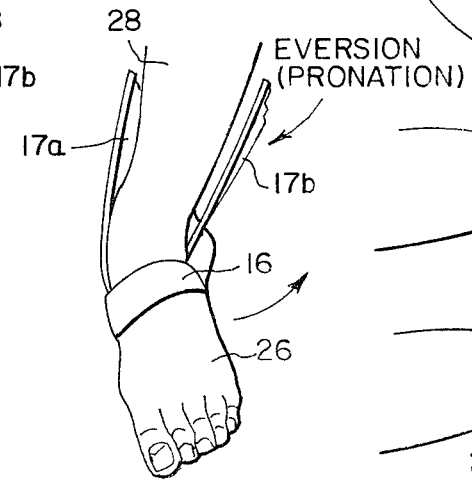
FIG. 5*b* of the drawing is a perspective view of the invention wherein the user's foot is in eversion.

Maintain leg 28 in a straight position as shown in FIG. 1 and pull the foot up toward the shin and toward the inside (dorsal flexion, FIG. 4*b* and inversion, FIG. 5*a* respectively) and while holding the foot up bring said foot across towards the outside and then slowly allow the elastic member 20*a* to return the foot to the starting position. Pull the foot up and to the outside (dorsal flexion, FIG. 4*b* and eversion, FIG. 5*b* hold it up and bring it across to the inside and slowly allow it to return to the starting position (plantar flexion, FIG. 4*a*). Accordingly two circles will have been made, in opposite directions and the cycle should also be repeated ten to fifteen times.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

Having regard to the foregoing disclosure the following is claimed as the inventive and patentable embodiments thereof:

1. An exercise device for knees and anlkes wherein a user sits on a chair while performing exercises, said device being attachable to the back of a chair and comprises:

(a) a first strap comprising two adjacent strap members joined to each other over a substantial length of each of said strap members, each of said strap members having a loop formed at one end thereof, said loop being joined to each other at substantially 90°, each one of said two adjacent strap members having end extension that extends through the loop at its opposite end and causes the first strap to a form a noose for a user's limb, (b) an elastic member attached to each end of said extensions, (c) a second strap for wrapping around a chair, the ends of the second strap being attached to the ends of said elastic members, and (d) adjustable means in said second strap to remove slack therein when a user is performing an exercise.

* * * * *